US011651729B2

(12) United States Patent
Cheng et al.

(10) Patent No.: US 11,651,729 B2
(45) **Date of Patent: *May 16, 2023**

(54) DRIVING METHOD FOR A DISPLAY DEVICE AND A DISPLAY DEVICE

(71) Applicant: NOVATEK MICROELECTRONICS CORP., Taiwan (CN)

(72) Inventors: Jhih-Siou Cheng, New Taipei (TW); Chun-Fu Lin, Taoyuan (TW); Po-Hsiang Fang, Zhubei (TW); Ju-Lin Huang, Zhubei (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/881,404

(22) Filed: Aug. 4, 2022

(65) Prior Publication Data

US 2022/0375403 A1 Nov. 24, 2022

Related U.S. Application Data

(63) Continuation of application No. 17/390,394, filed on Jul. 30, 2021, now Pat. No. 11,423,831.

(60) Provisional application No. 63/059,164, filed on Jul. 31, 2020.

(51) Int. Cl.
*G09G 3/32* (2016.01)

(52) U.S. Cl.
CPC ..... *G09G 3/32* (2013.01); *G09G 2310/0286* (2013.01); *G09G 2310/08* (2013.01); *G09G 2320/0233* (2013.01); *G09G 2320/0247* (2013.01); *G09G 2320/064* (2013.01)

(58) Field of Classification Search
CPC ..... G09G 3/32; G09G 2310/08; G09G 2310/0286; G09G 2320/0247; G09G 2320/0233; G09G 2320/064
See application file for complete search history.

(56) References Cited

U.S. PATENT DOCUMENTS

| | | | |
|---|---|---|---|
| 10,217,390 | B2 | 2/2019 | Gupta et al. |
| 2008/0246703 | A1 | 10/2008 | Smith |
| 2018/0075798 | A1 | 3/2018 | Nho et al. |
| 2018/0144676 | A1 | 5/2018 | Nadershahi |

FOREIGN PATENT DOCUMENTS

| | | | |
|---|---|---|---|
| CN | 101248480 | A | 8/2008 |
| CN | 102542991 | A | 7/2012 |
| CN | 103871366 | A | 6/2014 |

(Continued)

*Primary Examiner* — Muhammad N Edun
(74) *Attorney, Agent, or Firm* — Marshall, Gerstein & Borun LLP

(57) ABSTRACT

The present disclosure relates to a driving method for a display device and a display device. The display device includes a display driver, the display driver includes a plurality of driving channels each of which drives corresponding display unit according to display data in a pulse width modulation manner within one frame period, the method comprises: selectively enabling, in each sub-frame subset among a plurality of different sub-frame subsets of the frame period, different channel subset among a plurality of channel subsets of the plurality of driving channels to drive corresponding display unit, wherein each channel subset of the plurality of channel subsets includes two or more driving channels among the plurality of driving channels.

34 Claims, 8 Drawing Sheets

(56) References Cited

FOREIGN PATENT DOCUMENTS

| | | | |
|---|---|---|---|
| CN | 109935194 | A | 6/2019 |
| CN | 110517630 | A | 11/2019 |
| CN | 111402790 | A | 7/2020 |

DRIVING METHOD FOR A DISPLAY DEVICE AND A DISPLAY DEVICE

CROSS REFERENCE TO RELATED APPLICATIONS

This application is a continuation application of U.S. Ser. No. 17/390,394 filed on Jul. 30, 2021, which claims priority to U.S. Provisional Application No. 63/059,164 filed on Jul. 31, 2020, which are incorporated herein by reference in their entirety.

TECHNICAL FIELD

The present disclosure relates to the field of display, and more particularly, to a driving method for a display device and a display device.

BACKGROUND

In recent years, display technology has continued to develop, and as the display resolution of display systems such as Mini LED, Micro LED increases, the number of LED particles per unit area thereof also increases. Thus, this also means an increase in the number of driving integrated circuit (IC) having the same driving channel or the need for integrated driving IC with higher integration (that is, one driving IC includes more driving channels).

However, in high-resolution applications, there are several problems in driving such light-emitting unit arrays. For example, when the driving manner of pulse width modulation (PWM) is used to drive LED to emit light, especially at low grayscales, because there is almost one frame period from LED light-emitting to the next time of light-emitting, this will cause the visual flicker problem.

In addition, highly integrated driving IC will encounter greater coupling effect. Due to the coupling effect, different driving ICs or different driving channels of the same driving IC will interfere with each other, this may cause a false lightening action and cause the problem of uneven brightness in the display area. In addition, due to the coupling effect, a phase shift may occur between different driving ICs, this will also lead to the problem of uneven brightness in the display area.

Accordingly, it is desired in the art to provide an improved driving method for a display device and a display device.

SUMMARY

In view of this, the present disclosure provides a driving method for a display device and a display device, which are capable of, by means of selectively enabling a subset of different driving channels in different sub-frame subsets, making effective improvement with respect to the flicker problem and making improvement with respect to the problem of uneven brightness in the display area.

According to an aspect of the present disclosure, there is provided a driving method for a display device, the display device including a display driver, the display driver including a plurality of driving channels each of which drives corresponding display unit according to display data in a pulse width modulation manner within one frame period, the method comprising:

selectively enabling, in each sub-frame subset among a plurality of different sub-frame subsets of the frame period, different channel subset among a plurality of channel subsets of the plurality of driving channels to drive corresponding display unit, wherein each channel subset of the plurality of channel subsets includes two or more driving channels among the plurality of driving channels, said each sub-frame subset includes at least one sub-frame period in the frame period, and a sum of pulse widths of a driving signal outputted by each respective driving channel in each channel subset within one or more enabled sub-frame periods corresponds to a grayscale value of display data of said each driving channel used to drive corresponding display unit.

In addition, according to an embodiment of the present disclosure, the display driver includes a plurality of display driving chips, and different channel subsets among the plurality of channel subsets are formed by driving channels of different display driving chips.

In addition, according to an embodiment of the present disclosure, the display driver includes a plurality of display driving chips, and at least one display driving chip among the plurality of display driving chips includes two or more channel subsets among the plurality of channel subsets.

In addition, according to an embodiment of the present disclosure, the display driver is a display driving chip.

In addition, according to an embodiment of the present disclosure, the number of the plurality of channel subsets is greater than or equal to two, and the plurality of channel subsets at least include a first channel subset and a second channel subset, and selectively enabling, in each sub-frame subset among a plurality of different sub-frame subsets of the frame period, different channel subset among a plurality of channel subsets of the plurality of driving channels to drive corresponding display unit comprises:

selectively enabling, in a first sub-frame subset among the plurality of different sub-frame subsets, the first channel subset to drive corresponding display unit, and selectively enabling, in a second sub-frame subset among the plurality of different sub-frame subsets, the second channel subset to drive corresponding display unit.

In addition, according to an embodiment of the present disclosure, each sub-frame subset among the plurality of different sub-frame subsets includes one sub-frame period or two or more sub-frame periods, and only one channel subset in said each sub-frame subset is enabled to drive corresponding display unit.

In addition, according to an embodiment of the present disclosure, each channel subset includes the same number of driving channels.

In addition, according to an embodiment of the present disclosure, the number of the plurality of channel subsets is the same as the number of the plurality of sub-frame periods of the frame period.

In addition, according to an embodiment of the present disclosure, the driving method further comprises:

determining whether a grayscale of the display data is less than a predetermined threshold;

wherein in response to that the grayscale of the display data is less than a predetermined threshold, enabling, in each sub-frame subset among a plurality of different sub-frame subsets of the frame period, different channel subset among a plurality of channel subsets of the plurality of driving channels to drive corresponding display unit.

In addition, according to an embodiment of the present disclosure, two or more of the plurality of display driving chips share a scan line.

In addition, according to an embodiment of the present disclosure, the display device is an LED display device.

In addition, according to an embodiment of the present disclosure, the display driver is a constant current driver.

According to another aspect of the present disclosure, there is provided a display device, comprising:

a display module including a plurality of display units configured to be arranged in a array;

a display driver, the display driver including a driving unit that has a plurality of driving channels each of which drives corresponding display unit according to display data in a pulse width modulation manner within one frame period, wherein the display driver further selectively enables, in each sub-frame subset among a plurality of different sub-frame subsets of the frame period, different channel subset among a plurality of channel subsets of the plurality of driving channels to drive corresponding display unit, wherein each channel subset of the plurality of channel subsets includes two or more driving channels among the plurality of driving channels, said each sub-frame subset includes at least one sub-frame period in the frame period, and a sum of pulse widths of a driving signal outputted by each respective driving channel in each channel subset within one or more enabled sub-frame periods corresponds to a grayscale value of display data of said each driving channel used to drive corresponding display unit.

According to an aspect of the present disclosure, the display driver includes a plurality of display driving chips, and different channel subsets among the plurality of channel subsets are formed by driving channels of different display driving chips.

According to an aspect of the present disclosure, the display driver includes a plurality of display driving chips, and at least one display driving chip among the plurality of display driving chips includes two or more channel subsets among the plurality of channel subsets.

According to an aspect of the present disclosure, the display driver is a display driving chip.

According to an aspect of the present disclosure, the number of the plurality of channel subsets is greater than or equal to two, and the plurality of channel subsets at least include a first channel subset and a second channel subset, and the display driver is further configured to:

selectively enable, in a first sub-frame subset among the plurality of different sub-frame subsets, the first channel subset to drive corresponding display unit, and selectively enable, in a second sub-frame subset among the plurality of different sub-frame subsets, the second channel subset to drive corresponding display unit.

According to an aspect of the present disclosure, each sub-frame subset among the plurality of different sub-frame subsets includes one sub-frame period or two or more sub-frame periods, and only one channel subset in said each sub-frame subset is enabled to drive corresponding display unit.

According to an aspect of the present disclosure, each channel subset includes the same number of driving channels.

According to an aspect of the present disclosure, the number of the plurality of channel subsets is the same as the number of the plurality of sub-frame periods of the frame period.

According to an aspect of the present disclosure, wherein the display driver is further configured to:

determine whether a grayscale of the display data is less than a predetermined threshold;

wherein in response to that the grayscale of the display data is less than a predetermined threshold, the control unit enables, in each sub-frame subset among a plurality of different sub-frame subsets of the frame period, different channel subset among a plurality of channel subsets of the plurality of driving channels to drive corresponding display unit.

According to an aspect of the present disclosure, two or more of the plurality of display driving chips share a scan line.

According to an aspect of the present disclosure, the display device is an LED display device.

According to an aspect of the present disclosure, the display driver is a constant current driver.

Therefore, according to the above-described driving method for a display device and the display device of the present disclosure, by means of selectively enabling a subset of different driving channels in different sub-frame subsets, effective improvement can be made with respect to the flicker problem, and improvement can be made with respect to the problem of uneven brightness in the display area.

In addition, by means of determining whether the grayscale of the display data is less than a predetermined threshold, and selectively enabling different channel subset among a plurality of channel subsets of the plurality of driving channels to drive corresponding display unit, it can further effectively reduce mutual interference between the driving channels at low grayscales, and greatly reduce the phenomenon of uneven brightness in the display area.

In order to better understand the foregoing content, several embodiments are described in detail with reference to the drawings as follows.

BRIEF DESCRIPTION OF THE DRAWINGS

Through detailed description for the embodiments of the present disclosure in conjunction with the following drawings, the above and other objectives, features, and advantages of the present disclosure will become clearer. It should be understood that these drawings are used to provide a further understanding for the embodiments of the present disclosure, and constitute a part of the specification, they are used to explain the present disclosure together with the embodiments of the present disclosure, do not constitute a limitation to the present disclosure. In addition, in the drawings, the same reference numerals generally represent the same components or steps.

DETAILED DESCRIPTION OF THE EMBODIMENTS

Throughout the text of the specification (including the claims), the term "couple (or connect)" refers to any direct or indirect connection means. For example, where a first device is described to be coupled (or connected) to a second device in the text, it should be interpreted that the first device may be directly connected to the second device, or that the first device may be indirectly connected to the second device through another device or some connection means. Terms such as "first", "second", etc. mentioned in the entire specification (including the claims) of the present disclosure are used to name the elements or to distinguish between different embodiments or ranges, but not to limit the upper limit or lower limit of the number of elements. Moreover, wherever applicable, elements/components/steps referenced by the same numerals in the figures and embodiments refer to the same or similar parts. Elements/components/steps referenced by the same numerals or the same terms in different embodiments may be mutually referred to for relevant descriptions.

Figure 1:
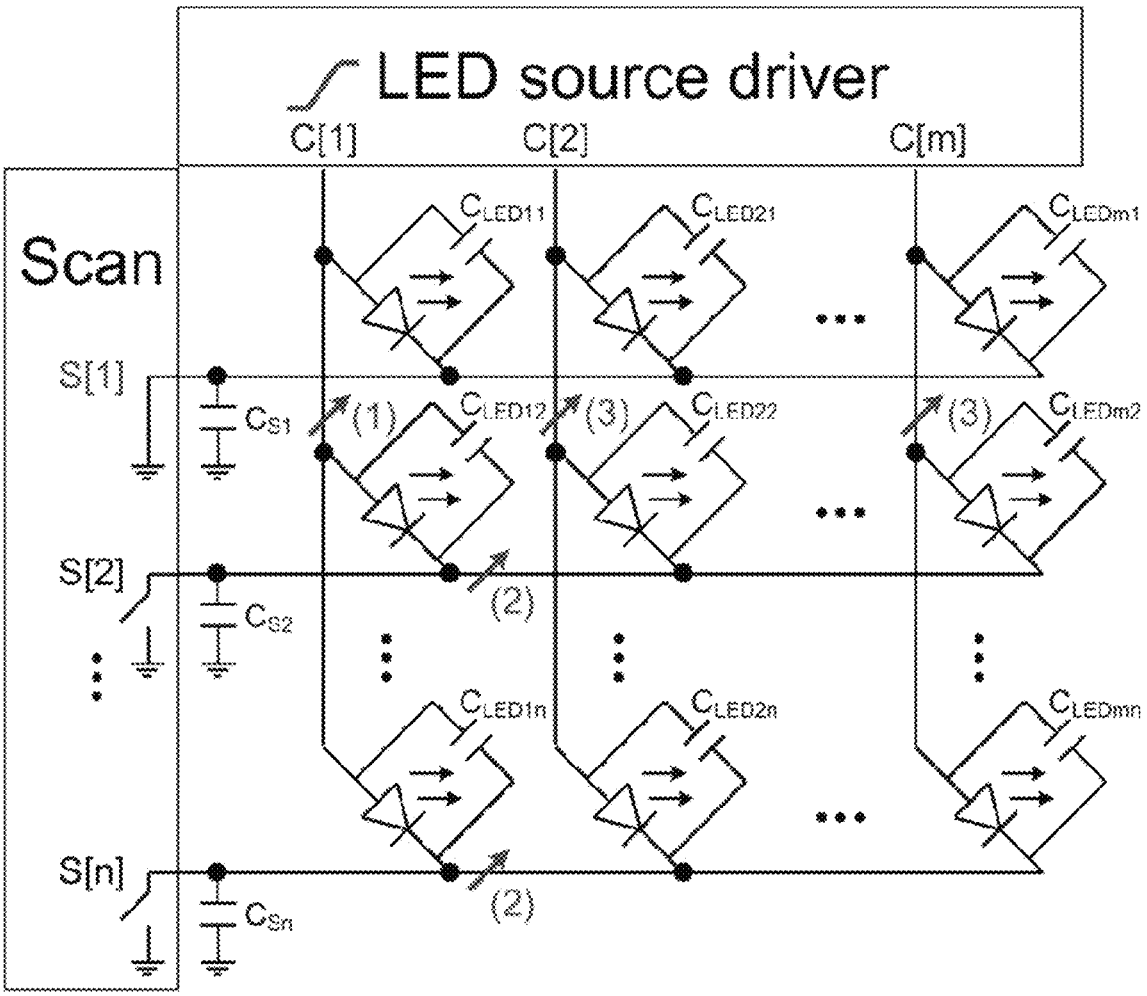
FIG. 1 is a schematic diagram showing a conventional display system including a driving IC and an LED array driven by it.

First, refer to FIG. 1, FIG. 1 shows a schematic diagram of a conventional driver and an LED array driven by it. In this embodiment, the LED array is taken as an example of the light-emitting unit array, the LED array is composed of m columns and n rows of LED. Such a light-emitting unit array may be used as a display panel of a display device or a part of a display panel. As shown in the figure, each row of the LED array is connected to the scan line, S[n] represents a switch control signal of the switch circuit that controls the scan line, it is used to select one row of LED pixels to be driven, and each column of the LED array is connected to the driver through the data line, so that the LED array is driven by the driver to emit light. For example, the LED driver can output a data driving signal in the form of a current pulse signal in the passive pulse width modulation (PWM) manner from top to bottom so as to drive the LED progressively, but when driving any row of LED, it requires charging n columns of load CLED[m1:mn] at the same time. And the driver may include a channel switch, and determine, by means of turning on/turning off the channel switch, whether to provide driving current to the corresponding one or more columns of LED. It can be understood that the driver in this example may be used as a whole to drive the LEDs of the respective channels (columns), or it may include a plurality of driving units therein, and each driving unit may be used to drive one or more corresponding columns of light-emitting unit.

Due to the presence of capacitive elements in the LED array, there will be coupling between adjacent columns of LED when the channel switch is turned on, which may cause the LED in an adjacent column still to be lightened by mistake although the driving channel corresponding to the adjacent column is scheduled to be turned off. For example, as shown by the arrow in FIG. 1, when the row of LED is controlled by the switch control signal S[1] for display, the corresponding scan line is floated by the switch control signals S[2]~S[N], at this time, if the channel switch corresponding to column C[1] is turned on and the channel switch corresponding to column C[2] is scheduled to be turned off, the data driving signal that drives the LED in column C[1] is coupled to the data line of column C[2] through the capacitance path shown (1)→(2)→(3), which may cause the LED of column C[2] to be lightened by mistake.

Figure 2:
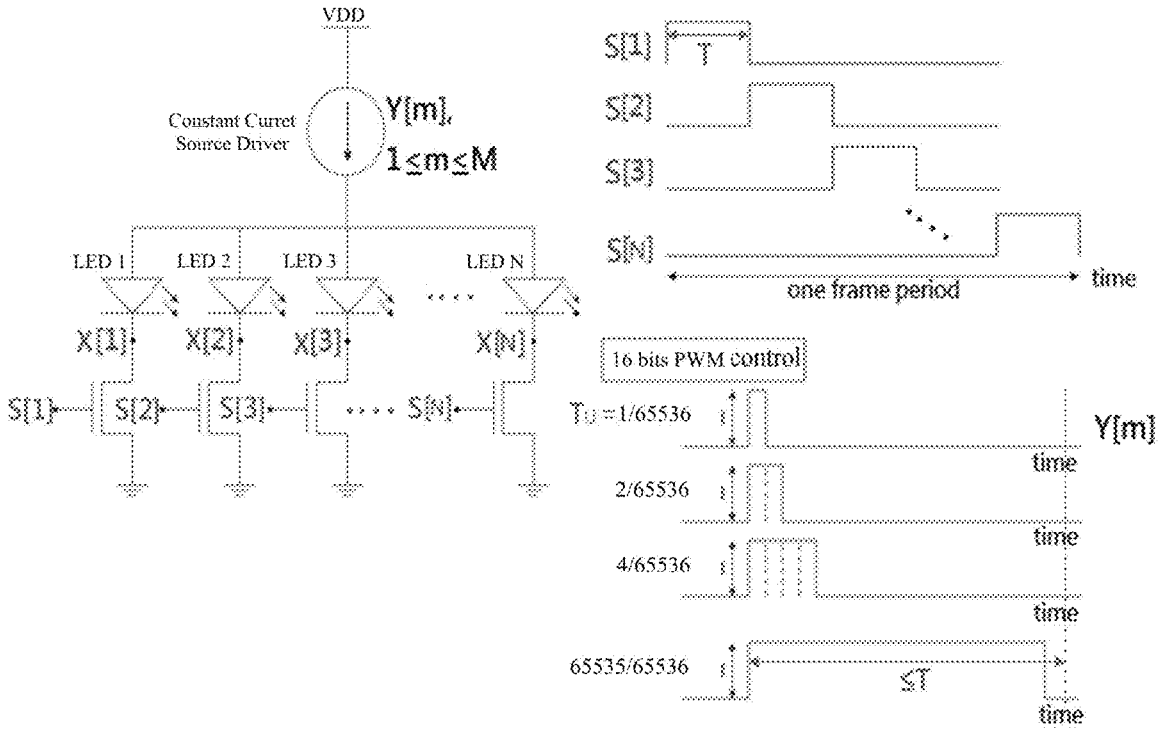
FIG. 2 is a schematic diagram showing the driving principle of a conventional current driving IC.

FIG. 2 shows a schematic diagram illustrating the driving principle of a conventional current driving IC. The LED driver in FIG. 1 is, for example, a constant current source driver.

S [n] represents a switch control signal of the switch circuit that controls the scan line, and is used to select one row of LED pixels to be driven. A switch-on time length of each scan line is represented by T, and T is related to the number of scan lines of the display panel and the display refresh rate. X[n] is a scan driving signal provided to the scan line (which is connected to the cathode of the LED) through the switch circuit of the scan line. The constant current source driver outputs, through the data line, a current pulse signal Y[m], which is a pulse width modulation (PWM) signal. The vertical axis of the current pulse signal Y[m] represents the current value, and the horizontal axis thereof is time. The pulse width is equal to a time length that the LED pixel is lightened, and is determined by the grayscale data to be displayed. For example, if 16-bit data (i.e., grayscale range=0~65535) is desired to be displayed, it may be set that the time length that does not exceed T is divided equally into $2^{16}$=65536 unit time $T_U$, when the constant current source driver does not output current, it represents the lowest grayscale, when the pulse width is 65535*TU, it represents the highest grayscale. The output current (I) of the constant current source driver is determined according to the brightness required by the panel. When the brightness required by the panel becomes higher, the current outputted by the respective data driving channel needs to increase. In addition, as for data driving channels that drive LEDs of the same color, the outputted current values are the same, but the current values for driving LEDs of different colors may be different.

Figure 3:
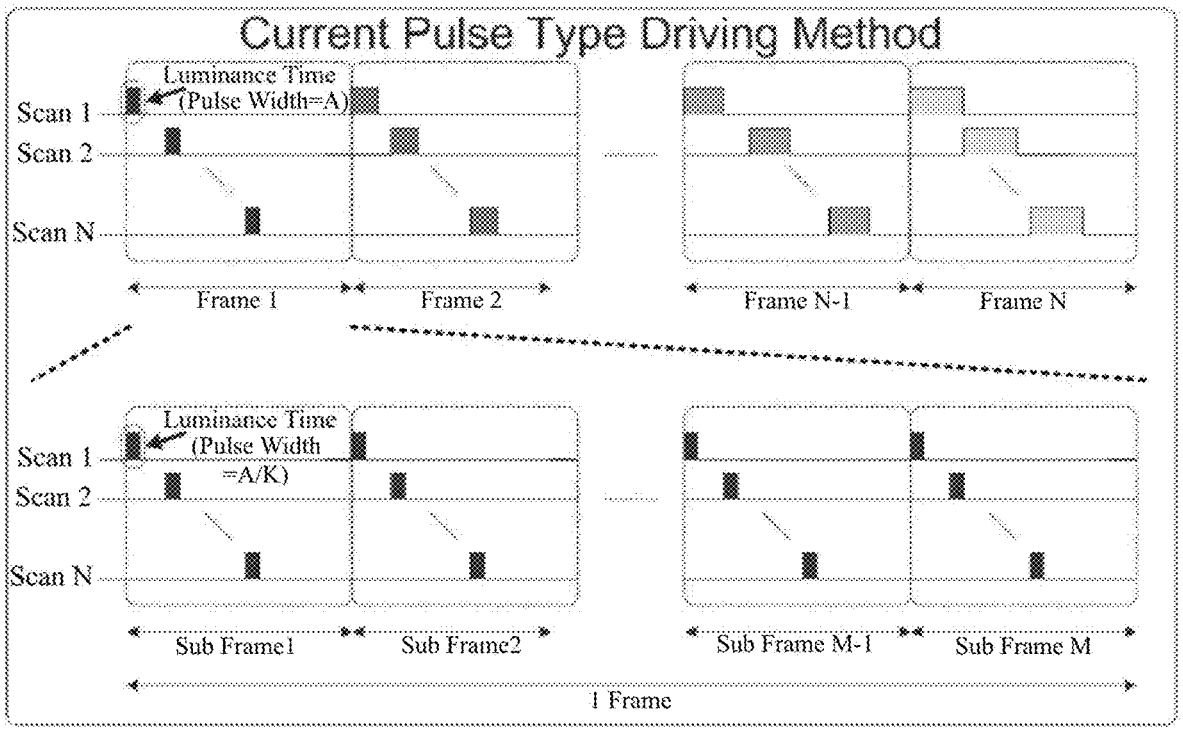
FIG. 3 is explanatory diagrams showing a conventional current pulse type driving method.

Hereinafter, the principle of the current pulse type driving method will be explained with reference to FIG. 3. As described above with reference to FIG. 2, in a display panel driven by a current pulse type, the display grayscale is determined by the display time, the display time is marked as the light-emitting time in FIG. 3, its time length is the pulse width A of the current pulse signal Y[m] (in terms of one frame period) or A/K (in terms of one frame period). Thus, the light-emitting time is short when the grayscale is low. Therefore, in the case shown in upper portion of FIG. 3, the time interval between the LED pixel light-emitting and the next time of light-emitting is relatively large (for example, it may be close to the time of one frame), which may cause the flicker problem to occur visually. It should be noted that, waveform of the switch control signal S [n] is not described in FIG. 3. Although the signals in FIG. 3 are marked as scan line 1 to scan line N, what they describe is not waveform of the switch control signal S [n], but rather the pulse width of the current pulse signal Y[m] outputted by the driving channel during respective scan line period in the frame period or sub-frame period, this pulse width will not exceed the period during which the switch control signal S [n] of the respective scan line turns on the switch (that is, the scan line period). The description manners of FIGS. 10 to 13 described latter are also similar, although the signals in these figures are marked as scan line 1 to scan line N, what they actually describe is the pulse width of the current pulse signal Y[m] outputted by the driving channel during respective scan line period in the frame period or sub-frame period.

In the case shown in lower portion of FIG. 3, the pulse width of the current pulse signal to which the grayscale data corresponds is evenly dispersed among K sub-frame periods divided from one frame period, so that a sum of the light-emitting time of the LED pixel within one frame period remains the same, but the original continuous light-emitting time is dispersed (correspondingly, the pulse width T of the S[N] signal in lower portion of FIG. 3 must also be equally divided into T/K), so that time interval between two times of adjacent light-emitting becomes shorter, which can make improvement with respect to the flicker phenomenon that tends to occur when low-grayscale data is displayed.

While, although the improved driving method in lower portion of FIG. 3 divides sub-frames, all driving channels are driven in each sub-frame, and each driving channel is driven by a value of grayscale value/K in each sub-frame. However, when the LED pixels do not emit light in most of the sub-frames at extremely low grayscales, this way will still cause the flicker phenomenon and the uneven display problem.

Figure 4:
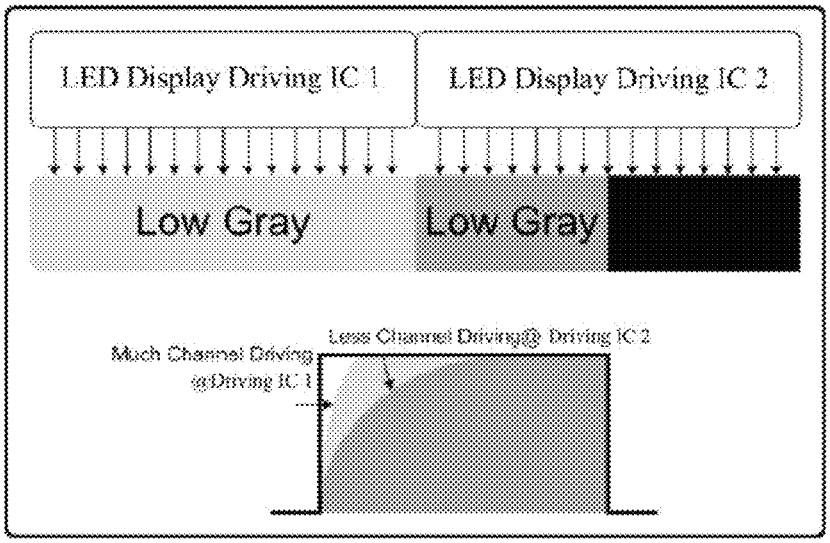
FIG. 4 is a schematic diagram showing abnormal grayscale display due to coupling effect in a conventional display system.

FIG. 4 shows the display abnormality problem caused by coupling. As shown in FIG. 4, in the case of a plurality of driving IC chips, for example, when all driving channels of driving IC chip 1 have output and only partial driving channels of driving IC chip 2 have output, even if the driving channels of chip 1 and chip 2 output the same grayscale value, the climbing speed is different due to the coupling phenomenon, which leads to the different light-emitting time. As a result, because the light-emitting time is short at low grayscales, the problem of inconsistent brightness in the display area is more obvious, because the light-emitting time is long at high grayscales, the problem of inconsistent brightness in the display area will be less obvious.

Figure 5:
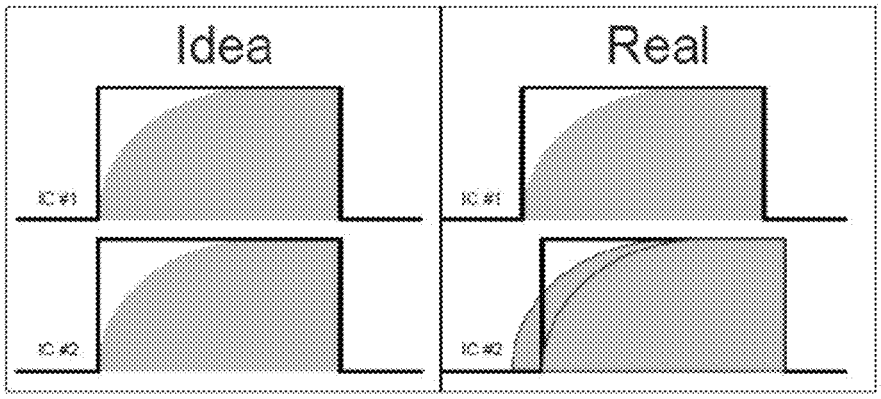
FIG. 5 is a schematic diagram showing an abnormal grayscale display caused by a phase shift between different chips due to coupling effect in a conventional display system.

FIG. 5 shows another display abnormality problem caused by coupling. As shown in FIG. 5, ideally, outputs of chip 1 and chip 2 are synchronized. However, in fact, outputs of respective chips will have a phase shift due to various reasons (for example, input reference clock, manufacturing differences, etc.). As a result, the leading chip will be coupled to the lagging chip, therefore, in the case where the grayscale data to be displayed by a certain data channel in chip 1 and a certain data channel in chip 2 are the same, pulse widths of the pulse signals outputted by the two data channels are inconsistent because of the phase shift, which in turn causes the brightness in the display areas driven by chip 1 and chip 2 to be inconsistent.

First Example of Display System

Figure 6:
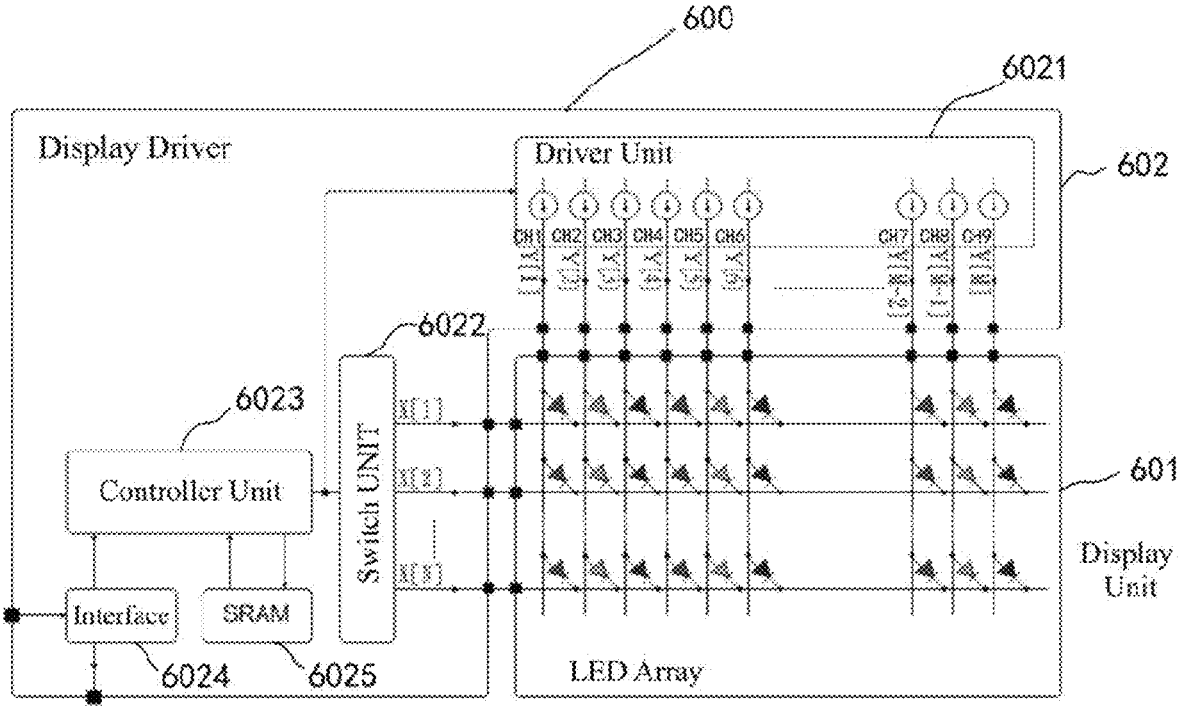
FIG. 6 is a schematic diagram showing a first example of a display system according to an embodiment of the present disclosure.

Wirth these problems being taken into consideration, a display device according to an embodiment of the present invention is provided. FIG. 6 is a schematic diagram showing a first example of a display system according to an embodiment of the present disclosure. As shown in FIG. 6, the display device 600 includes a display unit 601 and a display driver 602.

The display unit 601 includes a plurality of display units configured to be arranged in array. The display unit is, for example, LED, OLED, and so on. The respective columns of LED pixels may be arranged, for example, in a predetermined color pattern. For example, the LED pixels may be arranged in the order of red, green, and blue. Such a color pattern may be designed as required, and does not constitute a limitation to the technical solution of the present disclosure.

The display driver 602 may include, for example, a driving unit 6021, a switch unit 6022, and a control unit 6023.

It should be noted that, in one embodiment, the display driver 602 may be a single IC chip in which the driving unit 6021, the switch unit 6022, and the control unit 6023 are integrated into one chip.

In another embodiment, the constant current source driver 6021, the switch unit 6022, and the control unit 6023 each may also be an independent IC, and these three are collectively referred to as the display driver 602.

The driving unit 6021 in the display system 600 according to the first example is, for example, a constant current source driver 6021. In this embodiment, the constant current source driver 6021 is a single driving IC chip, it includes driving channels whose number is the same as the number of columns of data lines. Each driving channel is connected to one data line to drive the column of LED pixels.

The switch unit 6022 may include, for example, a plurality of switching transistors (for example, MOS transistors). Each switching transistor corresponds to one row of LED pixels. The switching transistor can use any suitable transistor as required, and does not constitute a limitation to the technical solution of the present disclosure.

The control unit 6023 controls the overall operation of the display driver 602. For example, the control unit 6023 controls data interaction with an external interface, and controls storage and/or reading of display data in the local SRAM. The control unit 6023 also selectively enables each driving channel in the constant current source driver 6021. The control unit 6023 can also control each driving channel to drive the corresponding display unit according to the display data in a pulse width modulation manner in one frame period.

For example, the control unit 6023 selectively enables, in each sub-frame subset among a plurality of different sub-frame subsets of the frame period of the display data, different channel subset among a plurality of channel subsets of the plurality of driving channels to drive corresponding display unit.

For example, each channel subset of the plurality of channel subsets includes two or more driving channels among the plurality of driving channels, said each sub-frame subset includes at least one sub-frame period in the frame period. A sum of pulse widths of a driving signal outputted by each respective driving channel in each channel subset within one or more enabled sub-frame periods corresponds to a grayscale value of display data of said each driving channel used to drive corresponding display unit.

It should be noted that the "different channel subset among a plurality of channel subsets of the plurality of driving channels" in the present disclosure may be different channel subset among a plurality of channel subsets obtained by dividing all channels in one division manner. In addition, it may be also different channel subset among a plurality of channel subsets obtained by dividing all channels in different division manners. Therefore, the different channel subsets may include different channels or the same channels.

For example, the number of the plurality of channel subsets is greater than or equal to two. In one embodiment, the plurality of channel subsets at least include a first channel subset and a second channel subset.

In one embodiment, each channel subset may include the same number of driving channels. In other embodiments, the number of driving channels in the respective channel subsets may not be all the same.

FIG. 6 shows nine driving channels CH1-CH9. For example, channels CH1-CH9 may be divided into three channel subsets, the first subset includes channels CH1-CH3, the second subset includes channels CH4-CH6, and the third subset includes channels CH7-CH9, this is the first division manner, which takes a plurality of driving channels corresponding to consecutive adjacent data lines as a channel subset. Alternatively, the first subset includes channels CH1, CH4, and CH7, the second subset includes channels CH2, CH5, and CH8, and the third subset includes channels CH3, CH6, and CH9, this is the second division manner, which takes a plurality of driving channels corresponding to interleaved spaced data lines as a channel subset.

In addition, during the driving process, channel subsets may also be dynamically divided, in other words, the driving channels that are driven in different frame periods are divided according to different channel subset division manners. For example, in one frame period or multiple frame periods, driving channels CH1-CH9 are divided into two channel subsets so as to drive corresponding display units during different sub-frame subsets, the first subset includes channels CH1-CH5, and the second subset includes channels CH6-CH9. In another frame period or multiple other frame periods, driving channels CH1-CH9 are divided into two channel subsets, the first subset includes channels CH1-CH4, and the second subset includes channels CH5-CH9.

The control unit 6023 may be configured to selectively enable, in the first sub-frame subset, the first channel subset to drive the corresponding display unit, and to selectively enable, in second first sub-frame subset, the second sub-frame subset channel subset to drive the corresponding display unit.

In one embodiment, each sub-frame subset among the plurality of different sub-frame subsets includes one sub-frame period or two or more sub-frame periods, and only one channel subset in said each sub-frame subset is enabled to drive corresponding display unit.

In one embodiment, the number of the plurality of channel subsets is the same as the number of the plurality of sub-frame periods of the frame period.

In one embodiment, the control unit 6023 may also determine whether a grayscale of the display data is less than a predetermined threshold.

In response to that the grayscale of the display data is less than a predetermined threshold, the control unit 6023 selectively enables, in each sub-frame subset among a plurality of different sub-frame subsets of the frame period, different channel subset among a plurality of channel subsets of the plurality of driving channels to drive corresponding display unit.

The driving method applied to the display device will be described in further detail below.

In this way, by means of enabling different driving channels of the same IC in different sub-frame subsets, especially at low grayscales, the flicker problem and the uneven display problem can be reduced.

In the present disclosure, the display driver 602 may be suitable for mini-LED or micro-LED applications, such LED applications are aimed at arraying and miniaturizing LED. For example, for micro-LED, the size of a single LED unit is usually in the order of 50 microns or less, and it can realize that each light-emitting unit is individually addressed and driven to emit light, just like OLED. Since such LED applications have a smaller LED size, high resolutions such as 4K or even 8K can be more easily implemented in the screens of electronic devices.

Therefore, the display device according to this embodiment can selectively enable a subset of different driving channels in different sub-frame subsets in a single driving chip, effective improvement can be made with respect to the flicker problem, and improvement can be made with respect to the problem of uneven brightness in the display area.

In addition, by means of determining whether the grayscale of the display data is less than a predetermined threshold, and selectively enabling different channel subset among a plurality of channel subsets of the plurality of driving channels to drive corresponding display unit, it can further effectively reduce mutual interference between the driving channels at low grayscales, and greatly reduce the phenomenon of uneven brightness in the display area.

Second Example of Display System

Figure 7:
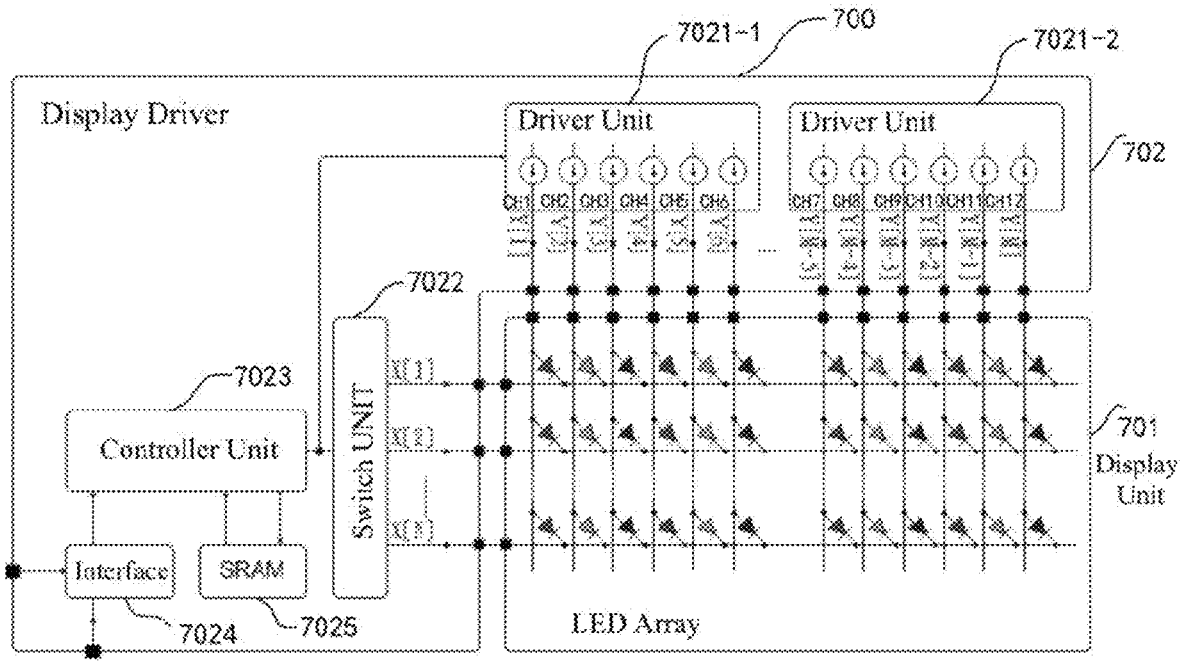
FIG. 7 is a schematic diagram showing a second example of a display system according to an embodiment of the present disclosure.

FIG. 7 is a schematic diagram showing a second example of the display system according to the embodiment of the present disclosure. As shown in FIG. 7, the display device 700 includes a display unit 701 and a display driver 702.

The display driver 702 may include, for example, a driving unit 7021, a switch unit 7022, and a control unit 7023.

The structure of the display device 700 is basically the same as that of the display device 600, except for the driving unit 7021. The driving unit 7021 is, for example, a constant current source driver 7021. In this embodiment, the constant current source driver 7021 includes a plurality of driving IC chips, for example, the constant current source driver 7021-1 and the constant current source driver 7021-2.

Although only two driving IC chips are shown in FIG. 7, three, four or more driving IC chips may be included. The number of driving channels of all driving IC chips is the same as the number of columns of data lines. Each driving channel is connected to one data line to drive the column of LED pixels.

Figure 8:
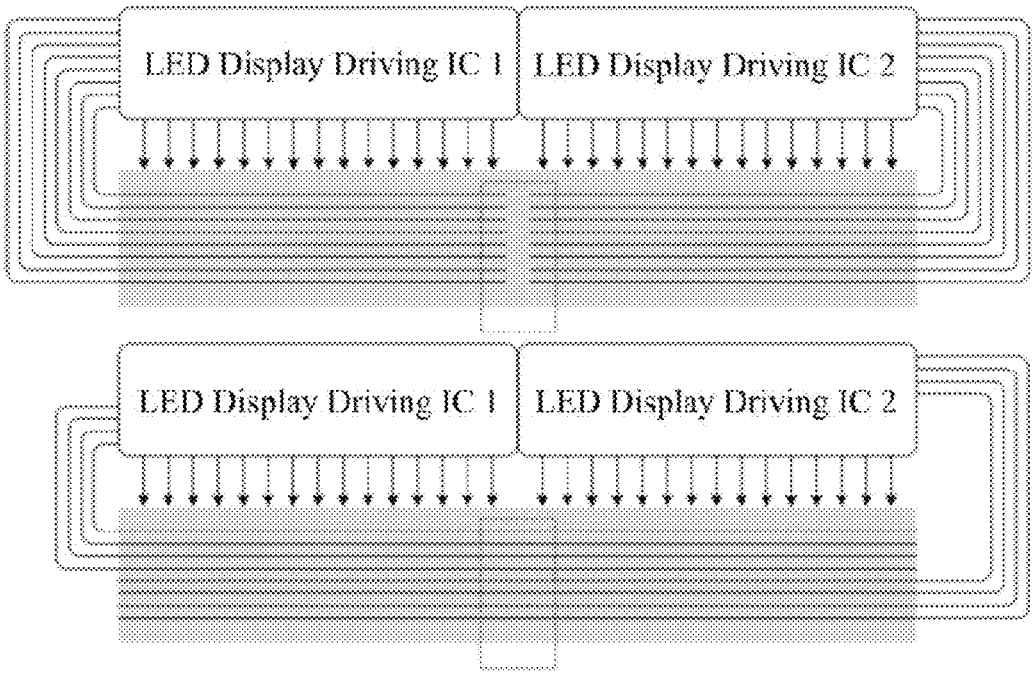
FIG. 8 is a schematic diagram showing shared scan lines of a plurality of chips of a display system according to an embodiment of the present disclosure.

FIG. 8 shows wiring of the two driver IC chips (IC1 and IC2). The upper part of FIG. 8 shows how IC1 and IC2 are scanned and driven by separate scanning lines. The lower part of FIG. 8 shows how IC1 and IC2 are scanned and driven by shared scan lines.

Due to the coupling effect between IC1 and IC2, it may cause the problems of false lightening and uneven display.

Similar to the first example, for example, the control unit 7023 selectively enables, in each sub-frame subset among a plurality of different sub-frame subsets of the frame period of the display data, different channel subset among a plurality of channel subsets of the plurality of driving channels to drive corresponding display unit.

For example, each channel subset of the plurality of channel subsets includes two or more driving channels among the plurality of driving channels, said each sub-frame subset includes at least one sub-frame period in the frame period. A sum of pulse widths of a driving signal outputted by each respective driving channels in each channel subset within one or more enabled sub-frame periods corresponds to a grayscale value of display data of said each driving channel used to drive corresponding display unit.

It should be noted that the "different channel subset among a plurality of channel subsets of the plurality of driving channels" in the present disclosure may be different channel subset among a plurality of channel subsets obtained by dividing all channels in one division manner. In addition, it may be also different channel subset among a plurality of channel subsets obtained by dividing all channels in different division manners. Therefore, the different channel subsets may include different channels or the same channels.

In an embodiment, different channel subsets among the plurality of channel subsets may be formed by driving channels of different display driving chips. For example, FIG. 7 shows a total of twelve driving channels CH1-CH12 of two driving chips, the driving channels of IC1 are CH1-CH6, and the driving channels of IC2 are CH7-CH12.

For example, channels CH1-CH12 may be divided into three channel subsets, the first subset includes channels CH1-CH4, the second subset includes channels CH5-CH8, and the third subset includes channels CH9-CH12.

In another embodiment, channels CH1-CH12 may be divided into six channel subsets, the first subset includes channels CH1-CH2, the second subset includes channels CH3-CH4, the third subset includes channels CH5-CH6, the fourth subset includes channels CH7-CH8, the fifth subset includes channels CH9-CH10, and the sixth subset includes channels CH11-CH12. In this way, at least one display driving chip in the plurality of display driving chips includes more than two channel subsets among the plurality of channel subsets.

With all the driving channels of all the driving chips as a whole, the division manner for the channel subset may be that a plurality of driving channels corresponding to consecutive adjacent data lines are taken as a channel subset, or a plurality of driving channels corresponding to interleaved spaced data lines are taken as a channel subset.

For example, the number of the plurality of channel subsets is greater than or equal to two. In one embodiment, the plurality of channel subsets include at least a first channel subset and a second channel subset.

The control unit 6023 may be configured to selectively enable, in the first sub-frame subset, the first channel subset to drive the corresponding display unit, and to selectively enable, in second first sub-frame subset, the second sub-frame subset channel subset to drive the corresponding display unit.

In one embodiment, each sub-frame subset among the plurality of different sub-frame subsets includes one sub-frame period or two or more sub-frame periods, and only one channel subset in said each sub-frame subset is enabled to drive corresponding display unit.

In one embodiment, each channel subset may include the same number of driving channels. In other embodiments, the number of driving channels in the respective channel subsets may not be all the same.

In one embodiment, the number of the plurality of channel subsets is the same as the number of the plurality of sub-frame periods of the frame period.

In one embodiment, the control unit 7023 may also determine whether a grayscale of the display data is less than a predetermined threshold.

In response to that the grayscale of the display data is less than a predetermined threshold, the control unit 7023 selectively enables, in each sub-frame subset among a plurality of different sub-frame subsets of the frame period, different channel subset among a plurality of channel subsets of the plurality of driving channels to drive corresponding display unit.

The driving method applied to the display device will be described in further detail below.

In this way, by means of enabling different ICs or different driving channels of the respective IC in different sub-frame subsets, especially at low grayscales, the flicker problem and the uneven display problem can be reduced.

In the present disclosure, the display driver 702 may be suitable for mini-LED or micro-LED applications, such LED applications are aimed at arraying and miniaturizing LED. For example, for micro-LED, the size of a single LED unit is usually in the order of 50 microns or less, and it can realize that each light-emitting unit is individually addressed and driven to emit light, just like OLED. Since such LED applications have a smaller LED size, high resolutions such as 4K or even 8K can be more easily implemented in the screens of electronic devices.

Therefore, the display device according to this embodiment can selectively enable a subset of different driving channels in different sub-frame subsets in a plurality of driving chips, effective improvement can be made with respect to the flicker problem, and improvement can be made with respect to the problem of uneven brightness in the display area.

In addition, by means of determining whether the grayscale of the display data is less than a predetermined threshold, and selectively enabling different channel subset among a plurality of channel subsets of the plurality of driving channels to drive corresponding display unit, it can further effectively reduce mutual interference between the driving channels at low grayscales, and greatly reduce the phenomenon of uneven brightness in the display area.

First Embodiment of Driving Method

Figure 9:
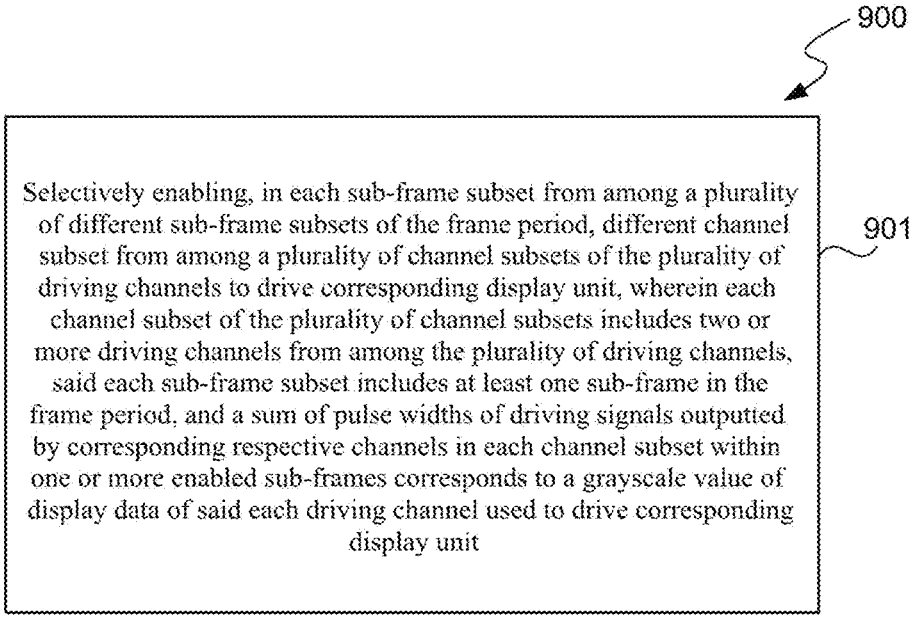
FIG. 9 is a flowchart showing a first implementation of a driving method of a display system according to an embodiment of the present disclosure.

Hereinafter, the driving method according to the present disclosure will be described with reference to FIG. 9. FIG. 9 is a flowchart showing a first implementation of a driving method of a display system according to an embodiment of the present disclosure.

The driving method of the present application is applied to, for example, the display device 600 and/or the display device 700 disclosed above. As described above, the display device 600 and/or the display device 700 includes a display driver, the display driver includes a plurality of driving channels, each driving channel of the display device 600 and/or the display device 700 shown drives corresponding display unit according to display data in a pulse width modulation manner within one frame period.

As shown in FIG. 9, the driving method 900 according to this implementation comprises:

Step S901: selectively enabling, in each sub-frame subset among a plurality of different sub-frame subsets of the frame period, different channel subset among a plurality of channel subsets of the plurality of driving channels to drive corresponding display unit, wherein each channel subset of the plurality of channel subsets includes two or more driving channels among the plurality of driving channels, said each sub-frame subset includes at least one sub-frame period in the frame period, and a sum of pulse widths of a driving signal outputted by eacg respective driving channel in each channel subset within one or more enabled sub-frame periods corresponds to a grayscale value of display data of said each driving channel used to drive corresponding display unit.

Specifically, unlike that all driving channels in each sub-frame period are enabled in the prior art, in the driving method according to the present disclosure, only different channel subset among a plurality of channel subsets of the plurality of driving channels are selectively enabled, in each sub-frame subset, to drive corresponding display unit.

As described above, the display driver may be a display driving chip, and different channel subset among the plurality of channel subsets is formed by the driving channels of the display driving chip.

Alternatively, the display driver may include a plurality of display driving chips, and different channel subset among the plurality of channel subsets is formed by driving channels of different display driving chips.

In one embodiment, the display driver includes a plurality of display driving chips, and at least one display driving chip among the plurality of display driving chips includes two or more channel subsets among the plurality of channel subsets.

In an embodiment, the number of the plurality of channel subsets is greater than or equal to two, and the plurality of channel subsets at least include a first channel subset and a second channel subset.

In addition, the first channel subset is selectively enabled, in a first sub-frame subset among the plurality of different sub-frame subsets, to drive corresponding display unit, and the second channel subset is selectively enabled, in a second sub-frame subset among the plurality of different sub-frame subsets, to drive corresponding display unit.

In an embodiment, each sub-frame subset among the plurality of different sub-frame subsets may include one sub-frame.

In another embodiment, each sub-frame subset may include two or more sub-frames, and only one channel subset in said each sub-frame subset is enabled to drive corresponding display unit.

Hereinafter, an example of the driving method according to the present disclosure will be described in detail with reference to FIGS. 10-13.

Figure 10:
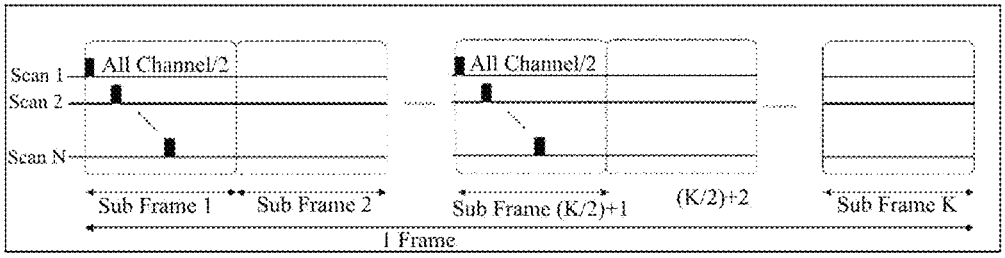
FIG. 10 is a schematic diagram showing a first example of a driving method of a display system according to an embodiment of the present disclosure.

FIG. 10 is a schematic diagram showing a first example of a driving method of a display system according to an embodiment of the present disclosure. As shown in FIG. 10, one frame is, for example, divided into K sub-frames. Each sub-frame subset includes one sub-frame. In addition, the driving channels of the display driver are divided into two channel subsets, and the number of channels included in each channel subset is, for example, the number of all channels/2.

For example, it is assumed that the number of channels is ten, when a driving operation is performed, the control unit of the display driver can enable half of the number of all channels (for example, channels CH1-CH5) in the first sub-frame period, and enable the remaining half of the channels (for example, channels CH6-CH10) in the (k/2+1)-th sub-frame period, so as to drive the corresponding display unit to emit light.

In addition, the grayscale values to be outputted by channels CH1-CH5 are outputted all in the first sub-frame, there is no need to output the grayscale values of channels CH1-CH5 in other sub-frames. The grayscale values to be outputted by channels CH6-CH10 are all outputted in the (k/2+1)-th sub-frame period, there is no need to output the grayscale values of channels CH1-CH5 in other sub-frames period. That the display driver drives, for example, in the first sub-frame period and the (k/2+1)-th sub-frame period is to shorten a time length of the continuous non-light-emitting time interval between two sub-frame periods when the display unit emits light as much as possible.

In the driving method according to this embodiment, each channel subset may include the same number of driving channels. For example, each channel subset includes five driving channels (i.e., 10/2).

In addition, the number of channel subsets may be the same as the number of sub-frame periods in the frame period. That is, the channel subset is two, and the sub-frame period is two.

Through the driving method shown in FIG. 10, it is not necessary to drive all the channels in each sub-frame, instead half of all the channels are driven in two different sub-frames respectively. By means of outputting the grayscale value (i.e., pulse width A) of the selected channel subset in one sub-frame, it is particularly advantageous for low grayscale situations. In this way, display unevenness caused by coupling can be advantageously avoided, and flicker can be further reduced.

Figure 11:
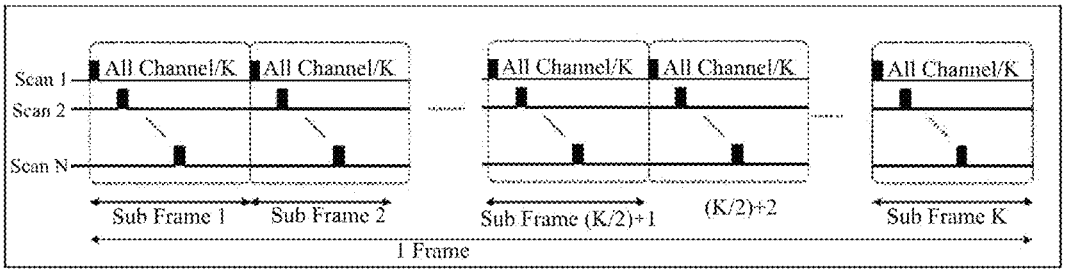
FIG. 11 is a schematic diagram showing a second example of a driving method of a display system according to an embodiment of the present disclosure.

FIG. 11 is a schematic diagram showing a second example of a driving method of a display system according to an embodiment of the present disclosure. As shown in FIG. 11, one frame period is, for example, divided into K sub-frame periods. Each sub-frame subset includes one sub-frame period. In addition, the driving channels of the display driver are divided into K channel subsets, and the number of channels included in each channel subset is, for example, the number of all channels/K.

When a driving operation is performed, the control unit of the display driver can enable the number of channels/K in the first sub-frame period, enable the number of channels/K in the second sub-frame period, . . . , and enable the number of channels/K in the (k/2+1)-th sub-frame. In this way, the number of channels/K is enabled in each sub-frame period to drive the corresponding display unit to emit light.

That is to say, in the second example shown in FIG. 11, the number of driving channels is divided equally into K subsets. One channel subset is enabled in each sub-frame period, the grayscale values (i.e., pulse width A) to be outputted by the first channel subset are all outputted in the first sub-frame period, without the need to output the grayscale values of the first channel subset in other sub-frame periods. The grayscale values (i.e., pulse width A) to be outputted by the second channel subset are all outputted in the second sub-frame period, without the need to output the grayscale values of the second channel subset in other sub-frame periods. In this way, the grayscale values (i.e., pulse width A) of one channel subset are outputted in each sub-frame period.

Through the driving method shown in FIG. 11, it is not necessary to drive all the channels in each sub-frame period, instead 1/K of the total number of channels are driven respectively in K different sub-frame periods. By means of outputting the grayscale value (i.e., pulse width A) of the selected channel subset in one sub-frame, it is particularly advantageous for low grayscale situations. In this way, display unevenness caused by coupling may be advantageously avoided, and flicker may be further reduced.

Figure 12:
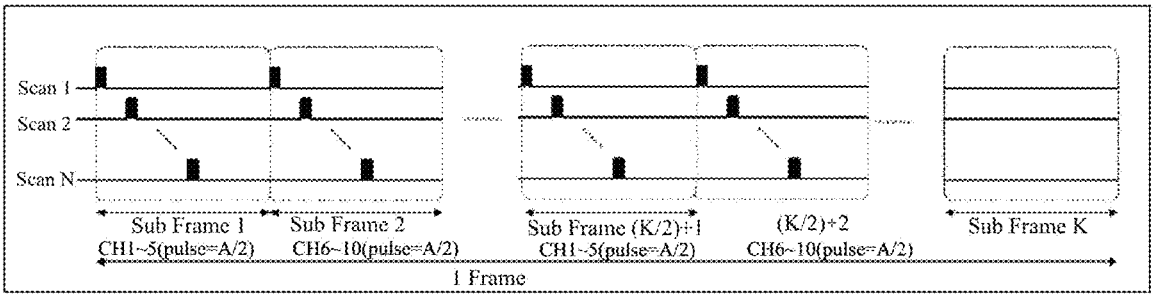
FIG. 12 is a schematic diagram showing a third example of a driving method of a display system according to an embodiment of the present disclosure.

FIG. 12 is a schematic diagram showing a third example of the driving method of the display system according to an embodiment of the present disclosure. As shown in FIG. 12, one frame period is, for example, divided into K sub-frame periods. Each sub-frame subset includes two sub-frame periods. In addition, the driving channels of the display driver are divided into two channel subsets, and the number of channels included in each channel subset is, for example, the number of all channels/2.

For example, it is assumed that the number of channels is ten, when a driving operation is performed, the control unit of the display driver can enable half of the number of all channels in the first sub-frame period (for example, channels CH1-CH5), and enable the remaining half of the channels (for example, channels CH6-CH10) in the (k/2+1)-th sub-frame period, so as to drive the corresponding display unit to emit light.

The difference over the first example shown in FIG. 10 is that half of the grayscale values to be outputted by the channels CH1-CH5 (that is, half of the pulse width A, A/2) is outputted in the first sub-frame period, and the other half of the grayscale values (that is, half of the pulse width A, A/2) to be outputted by CH1-CH5 is outputted in the (k/2+1)-th sub-frame period. In addition, half of the grayscale value to be outputted by channels CH6-CH10 (that is, half of the pulse width A, A/2) is outputted in the second sub-frame period, and the other half of grayscale values to be outputted by channels CH6-CH10 (that is, half of the pulse width A, A/2), is outputted in the (k/2+2)-th sub-frame period. As exampled in FIG. 12, it is assumed that one frame period is divided into twelve sub-frame periods, then the display units all emit light in the first, second, seventh, and eighth sub-frame periods, a time length of the spaced continuous non-light-emitting time interval is shortened to four sub-frame periods.

It should be noted that although FIG. 12 shows that channels CH6-CH10 are enabled in the sub-frame subset including the second sub-frame period and the (k/2+2)-th sub-frame period, it is also possible to enable channels CH6-CH10 in the sub-frame subset including the (K/4+1)-th sub-frame and the (3K/4+1)-th sub-frame period respectively, so as to drive the corresponding display unit to emit light. It is assumed that one frame period is divided into twelve sub-frame periods, the display units all emit light in the first, fourth, seventh, and tenth sub-frame periods, a time length of the spaced continuous non-light-emitting time interval is shortened to three sub-frame periods. This can further reduce flicker.

Through the driving manner shown in FIG. 12, it is not necessary to drive all the channels in each sub-frame, instead half of all the channels is driven in two different sub-frames respectively. In addition, by means of outputting half of the grayscale value of the selected channel subset in two sub-frames respectively, this is particularly advantageous for low grayscale conditions. In this way, display unevenness caused by coupling may be advantageously avoided, and flicker may be further reduced.

Figure 13:
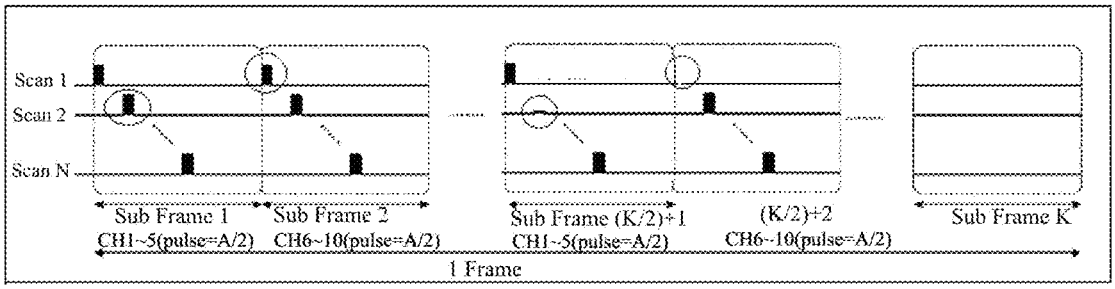
FIG. 13 is a schematic diagram showing a fourth example of a driving method of a display system according to an embodiment of the present disclosure.

FIG. 13 is a schematic diagram showing a fourth example of the driving method of the display system according to an embodiment of the present disclosure. As shown in FIG. 13, one frame period is, for example, divided into K sub-frame periods. Each sub-frame subset includes two sub-In addition, the driving channels of the display driver are divided into two channel subsets, and the number of channels included in each channel subset is, for example, the number of all channels/2.

For example, it is assumed that the number of channels is ten, when a driving operation is performed, the control unit of the display driver can enable half of the number of all channels in the first sub-frame period (for example, channels CH1-CH5), and enable the remaining half of the channels (for example, channels CH6-CH10) in the (k/2+1)-th sub-frame period, so as to drive the corresponding display unit to emit light.

The difference over the third example shown in FIG. 12 is that in the fourth example, for the same channel, each grayscale data (i.e., LED pixel at a different scan line position) is processed separately.

For example, in the second scan line selection interval of the first sub-frame period, the channel CH1 outputs all grayscale values (i.e., pulse width A) corresponding to the second scan line. In the second scan line selection interval of another sub-frame period of the same sub-frame subset (i.e., the (k/2+1)-th sub-frame period), the channel CH1 does not output a grayscale value.

Similarly, for example, the channel CH8 outputs all the grayscale values (i.e., the pulse width A) corresponding to the first scan line in the first scan line selection interval of the second sub-frame period. In the first scan line selection interval of another sub-frame period of the same sub-frame subset (i.e., the (k/2+2)-th sub-frame period), the channel CH8 does not output a grayscale value.

Although FIG. 13 only shows the channels CH1 and CH8, those skilled in the art can easily understand that the other channels can process each grayscale data separately.

Through the driving method shown in FIG. 13, it is not necessary to drive all the channels in each sub-frame, instead half of all the channels are driven in two different sub-frames respectively. In addition, by separately processing the grayscale value of each channel of the selected channel subset in each sub-frame, display unevenness caused by coupling may be avoided more flexibly, and flicker may be further reduced. This is particularly advantageous for low grayscale situations.

Second Embodiment of Driving Method

Figure 14:
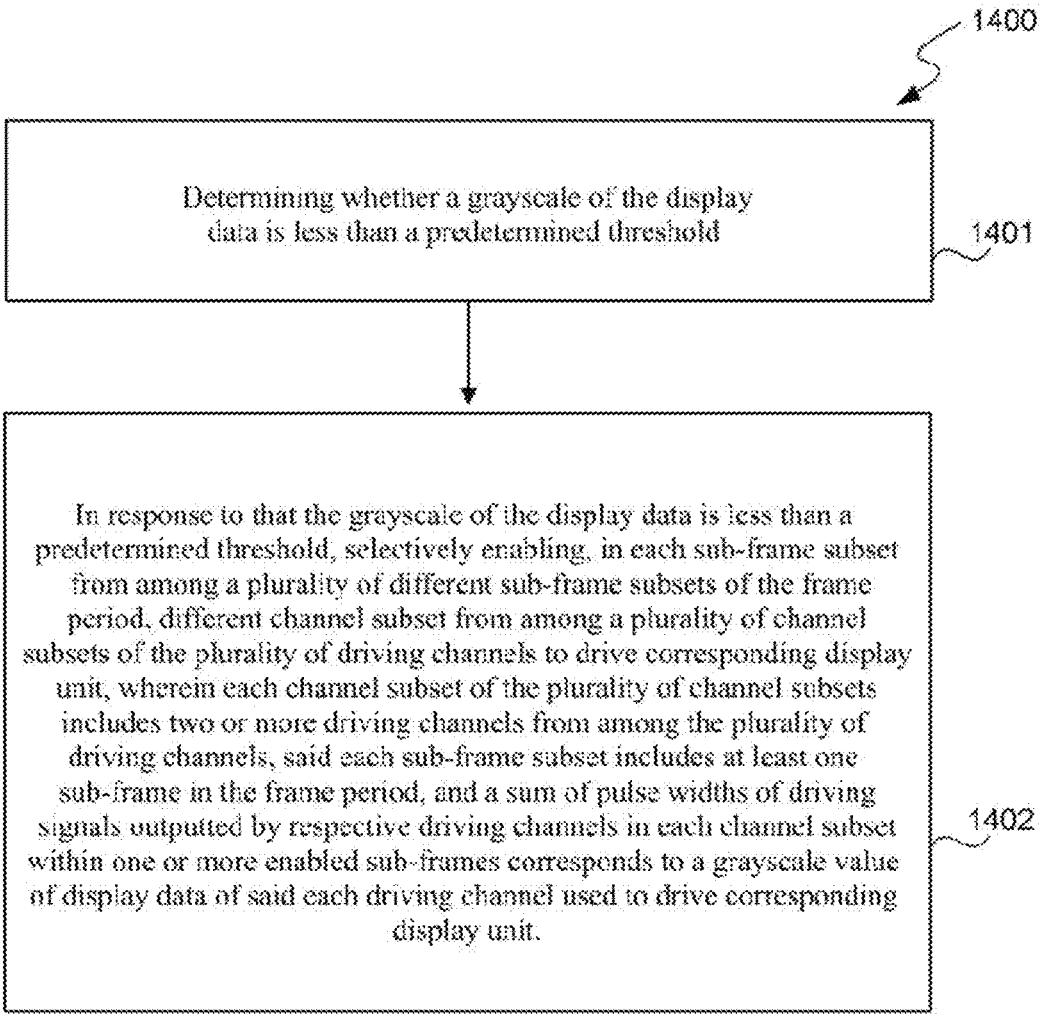
FIG. 14 is a flowchart showing a second implementation of a driving method of a display system according to an embodiment of the present disclosure.

Hereinafter, a second implementation of a driving method according to the present disclosure will be described with reference to FIG. 14. FIG. 14 is a flowchart showing a second implementation of a driving method of a display system according to an embodiment of the present disclosure.

The driving method of the present application is applied to, for example, the display device 600 and/or the display device 700 disclosed above. As described above, the display device 600 and/or the display device 700 includes a display driver, the display driver includes a plurality of driving channels, each driving channel of the display device 600 and/or the display device 700 shown drives corresponding display unit according to display data in a pulse width modulation manner within one frame period.

As shown in FIG. 14, the driving method 1400 according to this embodiment comprises:

Step 1401: determining whether a grayscale of the display data is less than a predetermined threshold;

Step: 1402: in response to that the grayscale of the display data is less than a predetermined threshold, enabling, in each sub-frame subset among a plurality of different sub-frame subsets of the frame period, different channel subset among a plurality of channel subsets of the plurality of driving channels to drive corresponding display unit, wherein each channel subset of the plurality of channel subsets includes two or more driving channels among the plurality of driving channels, said each sub-frame subset includes at least one sub-frame period in the frame period, and a sum of pulse widths of a driving signal outputted by each respective driving channel in each channel subset within one or more enabled sub-frame periods corresponds to a grayscale value of display data of said each driving channel used to drive corresponding display unit.

Specifically, in step S1401, it is first determined whether the grayscale of the display data is less than a predetermined threshold. That is to say, it is first determined whether the display data to be displayed is low-grayscale display data. When the grayscale of the display data is less than a predetermined threshold (for example, a grayscale value of 10), it is determined that the display data is low-grayscale display data.

It should be noted that the predetermined threshold may be set to different values according to different display devices. This specific value is not a limitation to the present application.

Then, in step S1402, in response to that the grayscale of the display data is less than a predetermined threshold, different channel subset among a plurality of channel subsets of the plurality of driving channels is selected enabled, in each sub-frame subset among a plurality of different sub-frame subsets of the frame period, to drive corresponding display unit.

Step S1402 is similar to step S901 in the first implementation, its detailed description is omitted herein. The various examples described above with reference to FIGS. 10-13 are also applicable to the driving method according to the second implementation.

Therefore, the driving method according to this embodiment can selectively enable a subset of different driving channels in different sub-frames of a plurality of driving chips in different sub-frame subsets, effective improvement can be made with respect to the flicker problem, and improvement can be made with respect to the problem of uneven brightness in the display area.

In addition, by means of determining whether the grayscale of the display data is less than a predetermined threshold, and selectively enabling different channel subsets among the plurality of channel subsets of the plurality of driving channels to drive the corresponding display unit, it can further effectively reduce mutual interference between the driving channels at low grayscales, and greatly reduce the phenomenon of uneven brightness in the display area, and further making improvement with respect to the flicker problem.

According to different design requirements, the implementation manners of the controller in the embodiments described above of the present disclosure may be hardware, firmware, software (i.e. program), or a combination of multiple of the three.

In terms of hardware, the blocks of the controller in the above embodiments may be implemented as a logic circuit on an integrated circuit. The relevant functions of the respective modules in the embodiments of the present disclosure may be implemented as hardware using hardware description languages (for example, Verilog HDL or VHDL) or other suitable programming languages. For example, the relevant functions of the respective modules in the embodiments of the present disclosure may be implemented in various logic blocks, modules, and circuits in one or more controllers, microcontrollers, microprocessors, application-specific integrated circuit (ASIC), digital signal processor (DSP), field programmable gate array (FPGA), and/or other processing units.

In terms of software and/or firmware, the relevant functions of the driving device may be implemented as programming codes. For example, the respective modules in the embodiments of the present disclosure are implemented using general programming languages (for example, C, C++, or assembly language) or other suitable programming languages. The programming codes may be recorded/stored in a recording medium. The recording medium, for example, includes a read only memory (ROM), a storage device, and/or a random access memory (RAM). A computer, a central processing unit (CPU), a controller, a microcontroller, or a microprocessor may read and perform the programming codes from the recording medium to achieve the relevant functions. As the recording medium, "non-transitory computer readable medium", for example, tape, disk, card, semiconductor memory, or programmable logic circuits, etc. may be used. Moreover, the program may also be provided to the computer (or CPU) via any transmission medium (communication network, broadcast radio wave, etc.). The communication network is, for example, the Internet, wired communication, wireless communication, or other communication mediums.

Although the present disclosure has been disclosed in the above embodiments, the embodiments are not intended to limit the present disclosure. It will be apparent to those skilled in the art that various modifications and variations may be made without departing from the scope or spirit of the present disclosure, the protection scope of the present disclosure therefore shall be subject to the scope defined by the claims.

What is claimed is:

1. A driving method for a display driver, the display driver including a plurality of driving channels each of which drives a corresponding display unit according to display data in a pulse width modulation manner within one frame period, the method comprising:

enabling, in a first sub-frame period of the frame period, a first channel subset of the plurality of driving channels to drive corresponding display units, and enabling, in a second sub-frame period of the frame period, a second channel subset of the plurality of driving channels to drive corresponding display units, wherein the first channel subset includes two or more driving channels among the plurality of driving channels, the second channel subset includes multiple of driving channels different from those included in the first channel subset, and a sum of pulse widths of driving signals outputted by a respective driving channel of each channel subset of the first channel subset and the second channel subset within at least one enabled sub-frame period in the frame period corresponds to a grayscale value of display data of the respective driving channel used to drive the corresponding display unit.

2. The driving method according to claim 1, wherein the first channel subset includes driving channels corresponding to odd-numbered data lines of a display panel among the plurality of driving channels, and the second channel subset includes driving channels corresponding to even-numbered data lines of the display panel among the plurality of driving channels.

3. The driving method according to claim 1, wherein the first channel subset includes driving channels corresponding to a plurality of first data lines spaced apart by a predetermined number of data lines among the plurality of driving channels, and the second channel subset includes driving channels corresponding to a plurality of second data lines spaced apart by the predetermined number of data lines, the predetermined number of data lines being greater than two, and the plurality of first data lines being different from the plurality of second data lines.

4. The driving method according to claim 1, wherein the frame period includes a first sub-frame subset and a second sub-frame subset, the first sub-frame subset includes at least the first sub-frame period, and the second sub-frame subset includes at least the second sub-frame period.

5. The driving method according to claim 4, wherein a sub-frame period of the second sub-frame subset is not adjacent to a sub-frame period of the first sub-frame subset.

6. The driving method according to claim 1, wherein the frame period includes a first sub-frame subset and a second sub-frame subset, the first sub-frame subset includes a plurality of sub-frame periods which are spaced apart by a predetermined number of sub-frame periods and include the first sub-frame period, and the second sub-frame subset includes a plurality of sub-frame periods which are spaced apart by the predetermined number of sub-frame periods, include the second sub-frame period and are different from those included in the first sub-frame subset.

7. The driving method according to claim 1, wherein the display driver includes a plurality of display driving chips, and the first channel subset and the second channel subset are formed by driving channels of different display driving chips, or the display driver includes a plurality of display driving chips, and at least one display driving chip among the plurality of display driving chips includes the first channel subset and the second channel subset, or the display driver is a display driving chip.

8. The driving method according to claim 7, wherein two or more of the plurality of display driving chips share scan lines.

9. The driving method according to claim 1, wherein the frame period includes a first sub-frame subset and a second sub-frame subset, the first sub-frame subset includes two or more sub-frame periods that include the first sub-frame period, the second sub-frame subset includes two or more sub-frame periods that include the second sub-frame period, and only one channel subset is enabled in each sub-frame subset to drive corresponding display units.

10. The driving method according to claim 1, wherein each sub-frame period of the first sub-frame period and the second sub-frame period includes a plurality of scan line periods corresponding to all scan lines, and the first channel subset or the second channel subset corresponding to the plurality of scan line periods is enabled during the plurality of scan line periods.

11. The driving method according to claim 1, further comprising:

determining whether the grayscale value of the display data is less than a predetermined threshold;

wherein in response to that the grayscale value of the display data is less than a predetermined threshold, enabling, in the first sub-frame period and the second sub-frame period, a corresponding different channel subset of the plurality of driving channels to drive corresponding display units respectively.

12. The driving method according to claim 1, wherein the display unit is a light emitting diode (LED).

13. A display driver, comprising:

a driving unit including a plurality of driving channels each of which drives a corresponding display unit according to display data in a pulse width modulation manner within one frame period;

a control unit configured to enable, in a first sub-frame period of the frame period, a first channel subset of the plurality of driving channels to drive corresponding display units, and to enable, in a second sub-frame period of the frame period, a second channel subset of the plurality of driving channels to drive corresponding display units, wherein the first channel subset includes two or more driving channels among the plurality of driving channels, the second channel subset includes multiple of driving channels different from those included in the first channel subset, and a sum of pulse widths of driving signals outputted by a respective driving channel of each channel subset of the first channel subset and the second channel subset within at least one enabled sub-frame period in the frame period corresponds to a grayscale value of display data of the respective driving channel used to drive the corresponding display unit.

14. The display driver according to claim 13, wherein the first channel subset includes driving channels corresponding to odd-numbered data lines of a display panel among the plurality of driving channels, and the second channel subset includes driving channels corresponding to even-numbered data lines of the display panel among the plurality of driving channels.

15. The display driver according to claim 13, wherein the first channel subset includes driving channels corresponding to a plurality of first data lines spaced apart by a predetermined number of data lines among the plurality of driving channels, and the second channel subset includes driving channels corresponding to a plurality of second data lines spaced apart by the predetermined number of data lines, the predetermined number of data lines being greater than two, and the plurality of first data lines being different from the plurality of second data lines.

16. The display driver according to claim 13, wherein the frame period includes a first sub-frame subset and a second sub-frame subset, the first sub-frame subset includes at least the first sub-frame period, and the second sub-frame subset includes at least the second sub-frame period.

17. The display driver according to claim 16, wherein a sub-frame period of the second sub-frame subset is not adjacent to a sub-frame period of the first sub-frame subset.

18. The display driver according to claim 13, wherein the frame period includes a first sub-frame subset and a second sub-frame subset, the first sub-frame subset includes a plurality of sub-frame periods which are spaced apart by a predetermined number of sub-frame periods and include the first sub-frame period, and the second sub-frame subset includes a plurality of sub-frame periods which are spaced apart by the predetermined number of sub-frame periods, include the second sub-frame period and are different from those included in the first sub-frame subset.

19. The display driver according to claim 13, wherein the display driver includes a plurality of display driving chips, the first channel subset and the second channel subset are formed by driving channels of different display driving chips, or the display driver includes a plurality of display driving chips, and at least one display driving chip among the plurality of display driving chips includes the first channel subset and the second channel subset, or the display driver is a display driving chip.

20. The display driver according to claim 13, wherein the frame period includes a first sub-frame subset and a second sub-frame subset, the first sub-frame subset includes two or more sub-frame periods that include the first sub-frame period, the second sub-frame subset includes two or more sub-frame periods that include the second sub-frame period, and only one channel subset is enabled in each sub-frame subset to drive corresponding display units.

21. The display driver according to claim 13, wherein each sub-frame period of the first sub-frame period and the second sub-frame period includes a plurality of scan line periods corresponding to all scan lines, and the first channel subset or the second channel subset corresponding to the plurality of scan line periods is enabled during the plurality of scan line periods.

22. The display driver according to claim 13, wherein the control unit is further configured to:

determine whether the grayscale value of the display data is less than a predetermined threshold;

wherein in response to that the grayscale value of the display data is less than a predetermined threshold, enable, in the first sub-frame period and the second sub-frame period, a corresponding different channel subset of the plurality of driving channels to drive corresponding display units respectively.

23. The display driver according to claim 13, wherein the display unit is a light emitting diode (LED).

24. A display device, comprising:

a display panel including a plurality of display units configured to be arranged in an array;

a display driver including a driving unit that has a plurality of driving channels each of which drives a corresponding display unit according to display data in a pulse width modulation manner within one frame period, wherein the display driver further includes a control unit configured to enable, in a first sub-frame period of the frame period, a first channel subset of the plurality of driving channels to drive corresponding display units, and to enable, in a second sub-frame period of the frame period, a second channel subset of the plurality of driving channels to drive corresponding display units, wherein the first channel subset includes two or more driving channels among the plurality of driving channels, the second channel subset includes multiple of driving channels different from those included in the first channel subset, and a sum of pulse widths of driving signals outputted by a respective driving channel of each channel subset of the first channel subset and the second channel subset within at least one enabled sub-frame period in the frame period corresponds to a grayscale value of display data of the respective driving channel used to drive the corresponding display unit.

25. The display device according to claim 24, wherein the first channel subset includes driving channels corresponding to odd-numbered data lines of the display panel among the plurality of driving channels, and the second channel subset includes driving channels corresponding to even-numbered data lines of the display panel among the plurality of driving channels.

26. The display device according to claim 24, wherein the first channel subset includes driving channels corresponding to a plurality of first data lines spaced apart by a predetermined number of data lines among the plurality of driving channels, and the second channel subset includes driving channels corresponding to a plurality of second data lines spaced apart by the predetermined number of data lines, the predetermined number of data lines being greater than two, and the plurality of first data lines being different from the plurality of second data lines.

27. The display device according to claim 24, wherein the frame period includes a first sub-frame subset and a second sub-frame subset, the first sub-frame subset includes at least the first sub-frame period, and the second sub-frame subset includes at least the second sub-frame period.

28. The display device according to claim 27, wherein a sub-frame period of the second sub-frame subset is not adjacent to a sub-frame period of the first sub-frame subset.

29. The display device according to claim 24, wherein the frame period includes a first sub-frame subset and a second sub-frame subset, the first sub-frame subset includes a plurality of sub-frame periods which are spaced apart by a predetermined number of sub-frame periods and include the first sub-frame period, and the second sub-frame subset includes a plurality of sub-frame periods which are spaced apart by the predetermined number of sub-frame periods, include the second sub-frame period and are different from those included in the first sub-frame subset.

30. The display device according to claim 24, wherein the display driver includes a plurality of display driving chips, the first channel subset and the second channel subset are formed by driving channels of different display driving chips, or the display driver includes a plurality of display driving chips, and at least one display driving chip among the plurality of display driving chips includes the first channel subset and the second channel subset, or the display driver is a display driving chip.

31. The display device according to claim 24, wherein the frame period includes a first sub-frame subset and a second sub-frame subset, the first sub-frame subset includes two or more sub-frame periods that include the first sub-frame period, the second sub-frame subset includes two or more sub-frame periods that include the second sub-frame period, and only one channel subset is enabled in each sub-frame subset to drive corresponding display units.

32. The display device according to claim 24, wherein each sub-frame period of the first sub-frame period and the second sub-frame period includes a plurality of scan line periods corresponding to all scan lines, and the first channel subset or the second channel subset corresponding to the plurality of scan line periods is enabled during the plurality of scan line periods.

33. The display device according to claim 24, wherein the control unit is further configured to:

determine whether the grayscale value of the display data is less than a predetermined threshold;

wherein in response to that the grayscale value of the display data is less than a predetermined threshold, enable, in the first sub-frame period and the second sub-frame period, a corresponding different channel subset of the plurality of driving channels to drive corresponding display units respectively.

34. The display device according to claim 24, wherein the display unit is a light emitting diode (LED).

* * * * *